US005326034A

United States Patent [19]

Peters

[11] Patent Number: 5,326,034

[45] Date of Patent: Jul. 5, 1994

[54] COMPACT CLOSED NOZZLE ASSEMBLY FOR A FUEL INJECTOR

[75] Inventor: Lester L. Peters, Columbus, Ind.

[73] Assignee: Cummins Engine Company, Inc., Columbus, Ind.

[21] Appl. No.: 97,214

[22] Filed: Jul. 27, 1993

[51] Int. Cl.[5] ..... F02M 47/00

[52] U.S. Cl. ..... 239/90; 239/95; 123/446

[58] Field of Search ..... 239/88-92, 239/95, 96, 533.9; 123/446, 500-502

[56] References Cited

U.S. PATENT DOCUMENTS

| | | | |
|---|---|---|---|
| 2,959,360 | 11/1960 | Nichols . | |
| 3,257,078 | 6/1966 | Mekkes | 239/90 |
| 3,379,374 | 4/1968 | Mekkes . | |
| 3,777,984 | 12/1973 | Greathouse . | |
| 4,463,901 | 8/1984 | Perr et al. | 239/95 |
| 4,531,672 | 7/1985 | Smith | 239/89 |

*Primary Examiner*—Karen B. Merritt

*Attorney, Agent, or Firm*—Sixbey, Friedman, Leedom & Ferguson

[57] ABSTRACT

A compact closed nozzle assembly for a fuel injector is provided which reduces the total length of the injector, minimizes the trapped volume of fuel and, thus, the response time of the injector and eliminates a high pressure joint in the injector body. The compact closed nozzle assembly of the injector includes a nozzle valve element positioned in an injector cavity adjacent injector orifices and operable to be placed in an open position in which fuel may flow a fuel transfer circuit through the injector orifices into the combustion chamber, and a closed position in which fuel flow through the injector orifice is blocked. A nozzle spring, which is shorter and larger in diameter than conventional nozzle springs, biases the nozzle valve element into the closed position. A stationary housing is mounted adjacent the nozzle valve element so that a portion of the housing is positioned within an inner radial extent of the nozzle spring while a portion of the fuel transfer circuit extends through the stationary housing within the inner radial extent of the spring. A check valve may be positioned in a check valve cavity formed in the stationary housing within the inner radial extent of the nozzle spring for preventing the flow of fuel from the metering chamber into a supply passage. A button device having a plurality of legs is positioned adjacent the stationary housing in an overlapping manner for operatively connecting the nozzle spring to the nozzle valve element.

28 Claims, 3 Drawing Sheets

COMPACT CLOSED NOZZLE ASSEMBLY FOR A FUEL INJECTOR

Technical Field

This invention relates to an improved closed nozzle assembly for fuel injectors which creates a simple, effective and more compact fuel injector assembly.

BACKGROUND OF THE INVENTION

Fuel injection into the cylinders of an internal combustion engine is most commonly acheived using either a unit injector system or a fuel distribution type system. In the unit injector system, fuel is pumped from a source by way of a low pressure rotary pump or gear pump to high pressure pumps, known as unit injectors, associated with corresponding engine cylinders for increasing the fuel pressure while providing a finely atomized fuel spray into the combustion chamber. Such unit injectors conventionally include a positive displacement plunger driven by a cam which is mounted on an engine driven camshaft. The fuel distribution type system, on the other hand, supplies high pressure fuel to injectors which do not pump the fuel but only direct and atomize the fuel spray into the combustion chamber.

A commonly used injector in both the unit injector and fuel distribution systems is a closed-nozzle injector. Closed-nozzle injectors include a nozzle assembly having a spring-biased tip valve element positioned adjacent the nozzle orifices for resisting blow back of exhaust gas into the pumping or metering chamber of the injector while allowing fuel to be injected into the cylinder. The tip valve element also functions to provide a deliberate, abrupt end to fuel injection thereby preventing a secondary injection which causes unburned hydrocarbons in the exhaust. For example, commonly owned U.S. Pat. No. 4,463,901 to Perr et al. disclosed a unit injector incorporating a conventional tip nozzle assembly including a valve element normally biased by a nozzle spring to block the nozzle orifices. When the pressure of the fuel within the nozzle cavity exceeds the biasing force of the nozzle spring, the tip valve element moves outwardly to allow fuel to pass through the nozzle orifices.

Recent and upcoming legislation resulting from a concern to improve fuel economy and reduce emissions continues to place strict emissions standards on engine manufacturers. In order for new engines to meet these standards, it is necessary to produce fuel injector systems capable of achieving higher injection pressures while maintaining accurate and reliable control of the metering and timing functions. As a result, closed-nozzle fuel injectors are undergoing structural modifications which better enable the injectors to produce and withstand the higher injection pressures. However, these improvements often undesirably increase the size by the injector which must conform to overall size restrictions dictated by the mounting arrangement on the engine. Therefore, fuel injector manufactures are continually seeking ways of maintaining or minimizing the overall size of the injectors while also incorporating the improvements. Moreover, any reduction in length or width of an injector often results in a decrease in the total size and weight of the engine thereby advancing the continuing effort to produce a compact, lightweight engine.

U.S. Pat. No. 4,531,672 to Smith (FIGS. 1 and 6) and U.S. patent application Ser. No. 065,583 (FIG. 2) entitled Individual Timing and Injection Fuel Metering System, both commonly assigned to the assignee of the present application, disclose unit fuel injectors having a conventional closed nozzle assembly. These closed nozzle injectors include outer and inner plungers positioned in an axial bore formed in the one or more barrels of the injector body to create a timing chamber between the plungers. A metering chamber is formed in the axial bore between the lower plunger and a spacer or disc which abuts the barrel to form the lower portion of the metering chamber. The closed nozzle assembly includes a nozzle housing having a nozzle cavity for housing a tip valve element and a spring housing for housing the biasing spring which biases the nozzle tip valve element in the closed position. The spring housing is positioned in compressive abutting relationship between the spring housing and the spacer. The bias spring, having a small diameter, is positioned in a bore centrally formed in the spring housing. As a result, a centrally disposed outer surface, provided in these embodiments by the spacer, must be positioned at the outer end of this central bore to support one end of the spring. Also, the metering chamber can not be positioned as far inward in the injector body as is desired to minimize the length of the injector. In addition, fuel transfer passages extending between the metering chamber and the nozzle cavity must be routed through the spacer around the spring housing central bore in the annular portion of the spring housing resulting in an unnecessarily large trapped fuel volume and consequently a longer than required response time. Moreover, the high pressure joint formed between the barrel and the spacer adjacent the metering chamber is extremely difficult to effectively seal.

As discussed above, many injectors incorporate features which, advantageously create and withstand higher injection pressures while undesirably increasing the overall size of the injector. For example, U.S. patent application Ser. No. 898,818, commonly assigned to the assignee of the present application, discloses a unit injector including three plungers which form an intensifier assembly as compared to the common diameter, two plunger injector of U.S. Pat. No. 4,463,901. The intensification assembly includes an upper and an intermediate plunger having larger diameters, and therefore larger cross-sectional areas, than the lower plunger. As a result, during each injection stroke of the plungers, an intensification effect caused by difference in cross-sectional areas of the plungers, increases the pressure of the fuel in the metering chamber and therefore the injection pressure. The larger diameter timing chamber also decreases the timing fluid pressure created in the timing chamber during the injection stroke thereby decreasing the stresses and forces in the outer portion of the injector body. However, this three-plunger design also undesirably increases the overall length and cost of the injector while increasing the size and weight of the engine.

U.S. Pat. Nos. 2,959,360 to Nichols and 3,379,374 to Mekkes disclose other types of closed nozzle assemblies for fuel injectors. Nichols discloses a closed nozzle assembly having a needle valve biased in a closed position by a coil spring. A fuel passage extends through the needle valve which is positioned at least partially within the coils of the spring. However, in order to control the needle valve and therefore injection, this assembly requires additional components, such as a movable housing and plunger assembly, positioned outward of the spring thereby undesirably increasing the length of the closed nozzle assembly and the injector. Moreover, the fuel passages extending through the needle valve do not supply fuel to the injector orifices for injection. As a result, longer and larger passages positioned outside the spring deliver a larger amount of fuel to the closed nozzle assembly than is necessary for injection resulting in a longer than necessary response time for each injection event.

U.S. Pat. No. 3,379,374 to Mekkes discloses a closed nozzle assembly having a spring-biased needle valve for controlling the flow of fuel from the injector orifices wherein the needle valve and fuel transfer passages are positioned within the spring coils. However, as a result, the needle valve is not positioned adjacent the injector orifices thus requiring an unnecessarily long transfer passage between the needle valve seat and the orifices. Consequently, after the needle valve closes, excess fuel left in this transfer passage may flow into the engine cylinder preventing the needle valve from effectively performing its intended function of providing a deliberate, abrupt end to injection, and disadvantageously causing secondary injections and unburned hydrocarbons in the exhaust. Also, by incorporating large, movable components within the spring coils, this closed nozzle assembly prevents other components, such as supply passages and a check valve, from being positioned within the spring coils.

Consequently, there is a need for a closed nozzle assembly which minimizes the length of the nozzle assembly and therefore the overall length of the injector while effectively functioning to control the discharge of fuel through the discharge orifices.

SUMMARY OF THE INVENTION

It is an object of the present invention, therefore, to overcome the disadvantages of the prior art and to provide a compact closed nozzle assembly for a fuel injector which minimizes the axial length of the injector.

It is another object of the present invention to provide a compact closed nozzle assembly for a unit injector which permits the use of a large diameter outer plunger, an intermediate plunger and a smaller diameter inner plunger while minimizing the axial length of the injector so as to conform to overall size restrictions dictated by the mounting arrangements on various engines.

It is yet another object of the present invention to provide a compact closed nozzle assembly which minimizes the number of high pressure joints in the injector thereby permitting higher injection pressures while reducing manufacturing costs.

It is a further object of the present invention to provide a closed nozzle assembly for a unit injector which reduces the volume of fuel trapped between the metering chamber and the discharge orifices during each injector stroke.

It is a still further object of the present invention to provide a compact closed nozzle assembly for a unit injector which permits the use of a timing chamber having a larger diameter than the metering chamber which reduces stress in the outer portion of the injector body.

Still another object of the present invention is to provide a closed nozzle assembly for a unit injector which reduces the spring rate of the nozzle spring to minimize the effect of the spring rate on the lift pressure of the nozzle element due to unavoidable variations in the dimensions of the components of the assembly thereby making spring force adjustment easier.

These and other objects are achieved by providing a fuel injector with a compact closed nozzle assembly comprising an injector body containing an injector cavity communicating with an injector orifice for discharging fuel into a combustion chamber wherein the injector body includes a fuel transfer circuit for transferring supply fuel to the injector orifice. A nozzle valve element positioned in the injector cavity adjacent the injector orifice is operable to be placed in an open position in which fuel may flow from the fuel transfer circuit through the injector orifice into the combustion chamber, and a closed position in which fuel flow through the injector orifice is blocked. A nozzle spring biases the nozzle valve element into the closed position. The injector body includes a stationary housing mounted adjacent the nozzle valve element so that a portion of the housing is positioned within an inner radial extent of the nozzle spring while a portion of the fuel transfer circuit extends through the stationary housing within the inner radial extent of the spring. The injector may include a plunger arrangement reciprocally mounted into the internal bore to define a metering chamber for receiving low pressure supply fuel. The fuel transfer circuit includes a supply passage for supplying fuel to the metering chamber and at least one transfer passage for transferring fuel from the metering chamber to the injection orifice. A check valve may be positioned in a check valve cavity formed in the stationary housing for preventing the flow of fuel from the metering chamber into the supply passage. The injector body may include an inner barrel mounted adjacent the nozzle spring so that one end of the nozzle spring abuts the inner barrel.

The closed nozzle assembly of the present invention may include a button device for operative connecting the nozzle spring to the nozzle element which includes a plurality of legs including a seating surface to abutment with the opposite end of the nozzle spring so as to be biased into abutment with the nozzle valve element. A plurality of grooves formed in one surface of the stationary housing are oriented to receive a corresponding leg of the button. The fuel transfer passages may extend from the metering chamber between the grooves or from the check valve cavity between the grooves to deliver fuel to the injector orifice. The stationary housing may include an outer section formed integrally with the inner barrel and positioned substantially entirely within the inner radial extend of the nozzle spring, and an inner section positioned between the outer section and the injector orifice. The grooves for receiving the legs of the button may be formed in the inner section of the stationary housing between the inner and outer sections or in the surface of the inner section positioned opposite the outer section.

The compact closed nozzle assembly of the present invention is especially advantageous when used with fuel injectors having features which cause the length of the injector to exceed standard length restrictions dictated by packaging constraints on various engines. In particular, the compact closed nozzle assembly of the present invention may be used with a unit injector having a three plunger arrangement which includes a timing plunger, a metering plunger and an intermediate plunger positioned in the internal bore between the timing plunger and the metering plunger to form a timing chamber. The timing and intermediate plungers have a larger diameter than the metering plunger and, therefore the timing chamber possesses a greater diameter than the metering chamber in order to reduce the stresses and forces caused by high pressure timing fluid in the upper portion of the injector body by reducing the pressure of the timing fluid during the injection stroke. This arrangement lengthens the injector beyond acceptable limits when combined with a conventional closed nozzle assembly. However, the compact closed nozzle assembly of the present invention, when combined with the three plunger, large diameter timing chamber style fuel injector, reduces the length of the injector to within acceptable limits.

BRIEF DESCRIPTION OF THE DRAWINGS

FIG. 11 is a fifth embodiment of the present invention including a one-piece stationary housing having a cylindrical recess which forms a portion of the metering chamber.

DETAILED DESCRIPTION OF THE PREFERRED EMBODIMENT

Throughout this application, the words "inward", "innermost", "outward" and "outermost" will correspond to the directions, respectively toward and away from the point at which fuel from an injector is actually injected into the combustion chamber of the engine. The words "outer" and "inner" will refer to the portions of the injector assembly which are, respectively, farthest away and closest to the engine cylinder when the injector is operatively mounted on the engine.

Figure 1A:
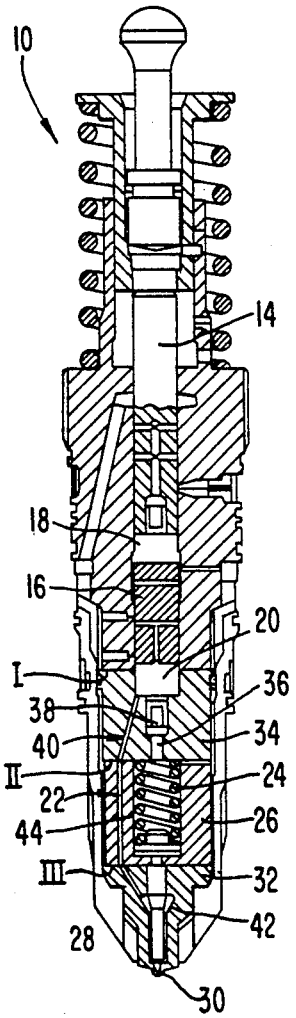
FIG. 1A PRIOR ART
FIG. 1A is a cross-sectional view of a prior art unit injector having a conventional closed nozzle assembly and common diameter timing and metering plungers.
Figure 1B:
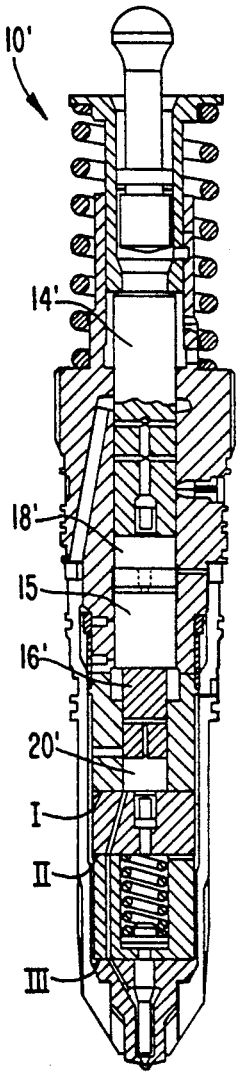
FIG. 1B is a cross-sectional view of a unit injector having a conventional closed nozzle assembly and a large diameter timing chamber.
Figure 1C:
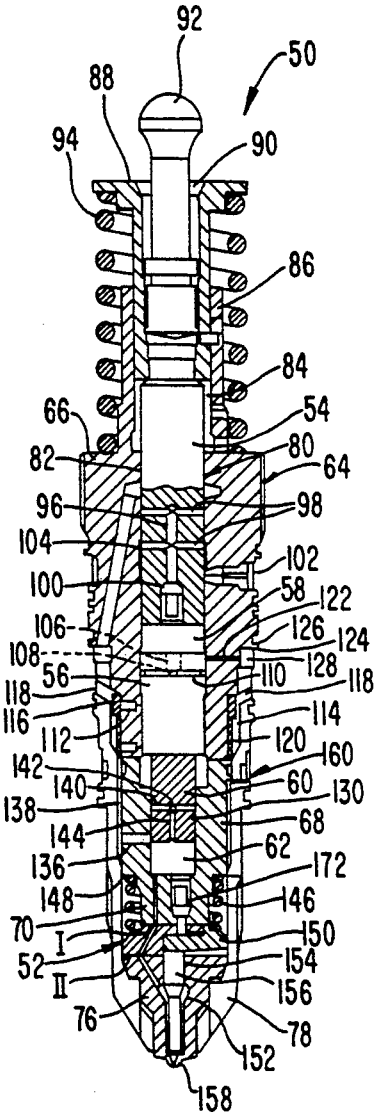
FIG. 1C is a cross-sectional view of a closed nozzle unit injector incorporating the compact closed nozzle assembly of the present invention.

FIGS. 1A, 1B and 1C are provided to clearly show the advantages of the compact closed nozzle assembly of the present invention when incorporated into a fuel injector over other injectors using conventional closed nozzle assemblies. FIG. 1A represents a prior art unit injector indicated generally at 10 which includes a timing plunger 14 and a metering plunger 16 having common diameters to form common diameter timing and metering chambers 18 and 20, respectively. Unit injector 10 also includes a conventional closed nozzle assembly indicated generally at 22 which includes a nozzle spring 24 positioned in a spring housing 26 for biasing a nozzle element 28, positioned in a nozzle housing 32, into a closed position against discharge orifices 30 formed in nozzle housing 32. The unit injector 10 also includes an inner barrel 34 positioned adjacent to and outwardly from the spring housing. Supply fuel flows into the metering chamber 20 via a supply passage 36 which includes a check valve 38 positioned between the metering chamber 20 and spring housing 26. A series of fuel transfer passages 40 extend from the metering chamber 20 to a nozzle cavity 42 formed in the nozzle housing 32. Because nozzle spring 24 possesses a small diameter and, thereby must be positioned in a spring cavity 44 formed along the axis of unit injector 10, metering chamber 20 must be formed a sufficient distance away from spring housing 26 so as to allow inner barrel 34 to function as a support surface for nozzle spring 24 while also providing sufficient space for supply passage 36, check valve 38 and fuel passages 40 which must extend inwardly from metering chamber 20.

Although the conventional closed nozzle assembly shown in FIG. 1A functions adequately, the conventional design limits the incorporation of beneficial modifications to other portions of the unit injector. For example, referring to FIG. 1B, a unit injector 10' is shown having many of the same components as the unit injector shown in FIG. 1A. The parts of the injector 10' of FIG. 1B that correspond to the parts of FIG. 1A have been given like reference numerals that are distinguished by a prime (') designation. However, the unit injector 10' of FIG. 1B includes a intermediate plunger 15 having a diameter similar to that of timing plunger 14' and larger than that of metering plunger 16'. As a result, metering chamber 20' is of a smaller diameter than timing chamber 18'. This modification results from an effort to decrease the stresses and forces acting in the upper portion of the injector body as a result of extremely high timing fluid pressures experienced in timing chamber 18 of unit injector 10 shown in FIG. 1A. In an effort to meet ever increasing emissions standards while improving fuel economy, unit injectors are continually required to achieve higher injection pressures while maintaining accurate and reliable control of the metering and timing functions. Assuming the unit injectors of FIGS. 1A and 1B are required to achieve the same injection pressure, the larger diameter timing chamber of unit injector 10' will function to significantly reduced the stresses developed in the upper portion of the unit injector. Moreover, the larger diameter timing chamber can be used to create an intensification effect based on the differing cross-sectional areas of intermediate plunger 15 and metering plunger 16' to achieve even higher injection pressures. However, the addition of a larger diameter timing chamber and the accompanying intermediate plunger also disadvantageously increases the overall length of the injector beyond acceptable limits as determined by the packaging constraints of various engines. Moreover, the high pressure joints indicated by I–III in FIGS. 1A and 1B are ever increasingly more difficult to seal as injection pressures increase.

Referring to FIG. 1C, the above-noted disadvantages of the prior art are minimized by the present compact closed nozzle assembly. FIG. 1C illustrates a unit injector generally at 50 which incorporates the compact closed nozzle assembly 52 of the present invention which is also illustrated more clearly in FIG. 2. Generally, the unit injector 50 includes a timing and an intermediate plunger 54 and 56, respectively, having similar diameters to form a timing chamber 58. A metering plunger 60 having a smaller diameter than the timing plunger 54 and intermediate plunger 56 forms a metering chamber 62 which, in turn, has a smaller diameter than timing chamber 58 and, in this respect, is similar to the injector shown in FIG. 1B. However, the overall length of unit injector 50 of FIG. 1C is shorter than the unit injector 10' of FIG. 1B (i.e. approximately 20 mm shorter). This reduction in the total length of the fuel injector is specifically accomplished by incorporating the compact closed nozzle assembly 52 of the present invention. As described hereinbelow, nozzle assembly 52 also reduces the number of high pressure joints from 3, as shown in FIG. 1B by I–III to two high pressure joints as indicated by I and II in FIG. 1C. In addition, the compact closed nozzle assembly 52 achieves other advantages discussed more fully hereinbelow.

Now referring to FIGS. 1C and 2, the compact closed nozzle assembly 52 and the unit injector incorporating the assembly 52 will now be described in detail. The closed nozzle injector 50 includes an injector body 64 formed from an outer barrel 66, an inner barrel 68, a stationary housing 70, a nozzle housing 76 and a retainer 78. The inner barrel 68, stationary housing 70 and nozzle housing 76 are held in a compressive abutting relationship in the interior of retainer 78 by outer barrel 66. The outer end of retainer 78 contains internal threads for engaging corresponding external threads on the lower end of outer barrel 66 to permit the entire unit injector body 64 to be held together by simple relative rotation of retainer 78 with respect to outer barrel 66.

Injector body 64 includes an injector cavity indicated generally at 80 which includes a plunger cavity 82 opening into a larger outer cavity 84 formed in an upper extension 86 of outer barrel 66. A coupling 88 is slidably mounted in outer cavity 84 and includes a cavity 90 for receiving a link 92. Coupling 88 and link 92 provide a reciprocable connection between the injector plungers and a driving cam (not shown) of the engine. A coupling spring 94 is positioned around extension 86 to provide an upward biased against coupling 88 to force link 92 against the injector drive train and corresponding cam (not shown).

As mentioned hereinabove, fuel injector 50 includes a timing plunger 54, intermediate plunger 56 and a metering plunger 60. Timing plunger 54 is positioned for reciprocable movement in plunger cavity 82 so as to abut the inner end of coupling 88. Intermediate plunger 56 is positioned for reciprocable movement in plunger cavity 82 between timing plunger 54 and metering plunger 60. The innermost end of timing plunger 54, together with the outermost end of intermediate plunger 56, forms the timing chamber 58 for receiving timing fluid from a timing fluid circuit (not shown). Timing plunger 54 includes an axial passage 96 communicating with timing chamber 58 and extending outwardly to connect with a pair of diametrically extending passages 98 spaced longitudinally along axial passage 96 in timing plunger 54. A spring biased inlet check valve 100 positioned in axial passage 96 inwardly of passages 98 prevents the flow of timing fluid from timing chamber 58 through axial passage 96 and passages 98. Outer barrel 66 includes a timing fluid supply port 102 extending radially from plunger cavity 82 for supplying timing fluid to timing chamber 58. Outer barrel 66 also includes an annular recess 104 formed in the inner wall of outer barrel 66 between timing plunger 54 and supply port 102. Annular recess 104 extends axially along plunger cavity 82 a sufficient distance to insure that at least one of passages 98 communicate with annular recess 104 and, therefore, supply port 102 at all times during plunger movement.

Intermediate plunger 56 includes an axial passage 106 communicating with timing chamber 58 at one end and with a radial passage 108 at an opposite end. An annular groove 110 formed in intermediate plunger 56 communicates with radial passage 108. Outer barrel 66 includes a timing fluid spill port 112 extending radially from plunger cavity 82 to an annular chamber 114 formed between outer barrel 66 and retainer 78. An annular spill ring 116 positioned around outer barrel 66 covers the opening of spill port 112 into chamber 114 and flexes radially outwardly at a predetermined pressure to allow timing fluid to spill from port 112 into chamber 114. A pair of drain ports 118 formed in retainer 78 adjacent annular chamber 114 directs timing fluid spilled into chamber 114 to drain. An annular spacer 120 positioned around the lower end of outer barrel 66 is used to position spill ring 116 in place over spill port 112. A drain passage 122 formed in outer barrel 66 extends radially outwardly from plunger cavity 82 adjacent timing chamber 58 to communicate with an annular groove 124 formed by the upper end of retainer 78 and an annular flange 126 formed on outer barrel 66. A circular ring valve 128 positioned in annular groove 124 around outer barrel 66 covers passage 122 to preventing timing fluid flow from timing chamber 58 until a predetermined pressure is reached. The ring valve 128 flexes to open passage 122 during the injection event under certain engine conditions, such as low speed operation to limit the fluid pressure in timing chamber 58 and, thus, the peak injection pressure. The design and function of spill ring 116 and ring valve 128 are described in more detail in commonly owned U.S. application Ser. No. 898,818 which is hereby incorporated by reference.

Figure 2:
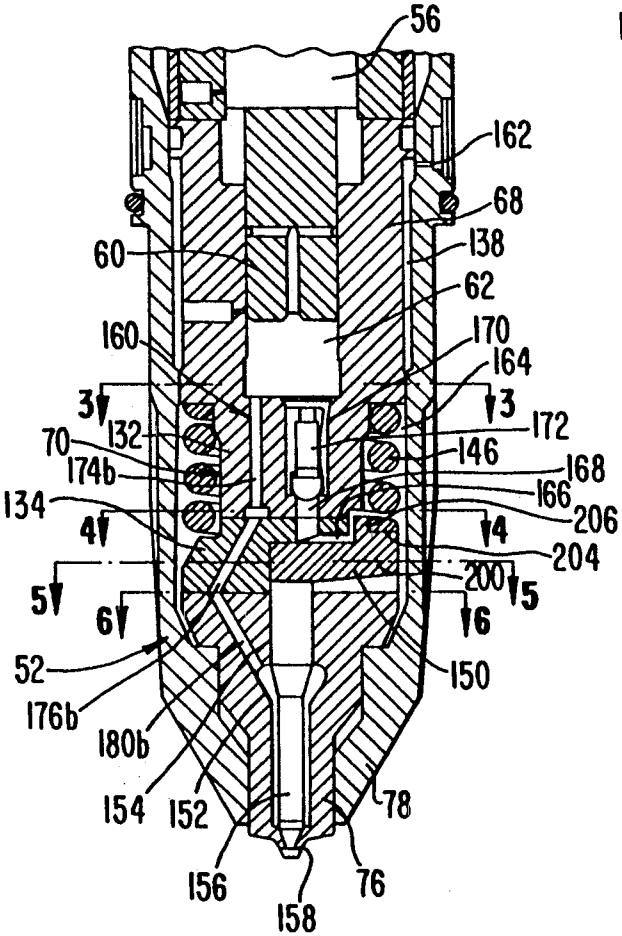
FIG. 2 is an enlarged, partial cross-sectional view of the unit injector of FIG. 1C incorporating the compact closed nozzle assembly of the present invention.

As shown in FIGS. 1C and 2, inner barrel 66 is generally cylindrically-shaped and includes a plunger cavity 130 positioned in axial alignment with plunger cavity 82. In the embodiments shown in FIGS. 1C, 2, 8 and 9, an outer section 132 of stationary housing 70 is formed integrally with inner barrel 68 to form metering chamber 62 at the innermost end of plunger cavity 130. A metering spill port 136 formed in inner barrel 68 extends radially from plunger cavity 130 adjacent metering chamber 62 to communicate with an annular channel 138. Metering plunger 60 includes an annular groove 140, a radial passage 142 and an axial passage 144 in communication with each other to permit fuel to flow from metering chamber 62 to spill port 136 depending on the position of metering plunger 60 during the operation of the injector.

In the embodiment shown in FIGS. 1C and 2, the compact closed nozzle assembly 52 of the present invention includes the stationary housing 70 which includes the outer section 132 and an inner section 134. Outer section 132 of stationary housing 70 is formed integrally with inner barrel 68. A nozzle spring 146 is positioned around outer section 132 and inner section 134 of stationary housing 70 and the outermost end of nozzle spring 146 abuts an inwardly facing annular land formed on the innermost end of inner barrel 68. The stationary housing 70 is sized to provide radial support to nozzle spring 146. A reciprocably mounted button 150 is positioned in an overlapping relationship with inner section 134 of stationary housing 70 for abuting the innermost end of nozzle spring 146, thereby operatively connecting nozzle spring 146 to nozzle valve element 156.

Nozzle housing 76 includes a nozzle cavity 152 for receiving injection fuel from metering chamber 62. A central bore 154 extends outwardly from nozzle cavity 152 through the outermost surface of nozzle housing 76. A nozzle valve element 156 is reciprocably mounted in central bore 154 and nozzle cavity 152 and extends to operatively engage button 150 at one end and injector orifice 158 at an opposite end when in a closed position. In this manner, nozzle spring 146 normally biases nozzle valve element 156 into a closed position blocking injector orifices 158. When the pressure of fuel within nozzle cavity 152 exceeds a predetermined level, nozzle valve element 156, and button 150, move outwardly against the biasing force of spring 146 to allow fuel to pass through the injector orifices 158 into the combustion chamber (not shown).

Figure 5:
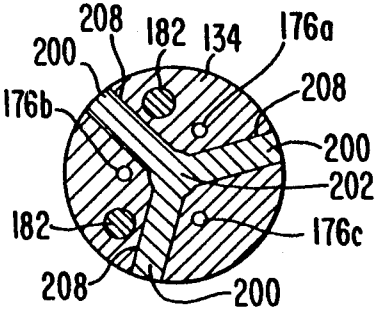
FIG. 5 is a cross-sectional view of a compact closed nozzle assembly of FIG. 2 taken along plane 5—5.
Figure 7:
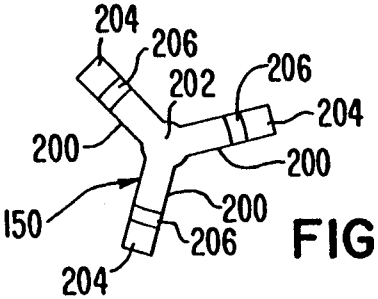
FIG. 7 is a top plan view of the button of the compact closed nozzle assembly of the present invention.

As shown in FIGS. 2, 5 and 7, button 150 includes three legs extending radially from a center hub 202 and equally spaced around the circumference of hub 202. Each leg 200 includes a seating surface 204 adjacent the end of the leg for engaging the inner end of nozzle spring 146. Each leg 200 also includes a flange 206 for providing radial support to the inner end of spring 146. As best shown in FIG. 5, inner section 134 of stationary housing 70 includes complementary grooves 208 formed in the innermost surface of inner section 134 adjacent nozzle housing 76. The three grooves 208 extend radially outward for receiving legs 200. As a result, button 150 reciprocably engages inner section 134 in an overlapping manner so that seating surfaces 204 are positioned to receive the inner end of nozzle spring 146.

A fuel transfer circuit 160 includes metering chamber 62 and various passages which will now be described in greater detail. As shown in FIG. 2, a supply port 162 provides communication between a fuel supply (not shown) and annular channel 138 formed between retainer 78 and inner barrel 68. An annular chamber 164, within which nozzle spring 146 is positioned, communicates with annular channel 138 and a radial supply passage 166 extending inwardly through inner section 134 of stationary housing 70. Radial passage 166 communicates with an axial supply passaged 168 which extends upwardly through inner section 134 and outer section 132 to communicate with a check valve cavity 170. A spring loaded ball check valve 172 positioned in check valve cavity 170 permits passage of fuel at a predetermined pressure from fuel supply port 162 to metering chamber 62 while preventing fuel flow from metering chamber 62 through axial supply passage 168.

Figure 4:
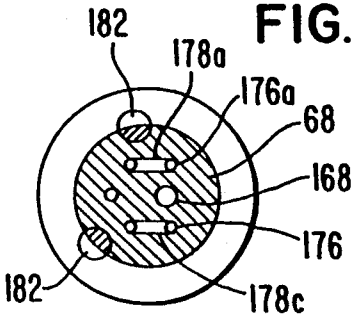
FIG. 4 is a cross-sectional view of the compact closed nozzle assembly of FIG. 2 taken along plane 4—4.
Figure 3:
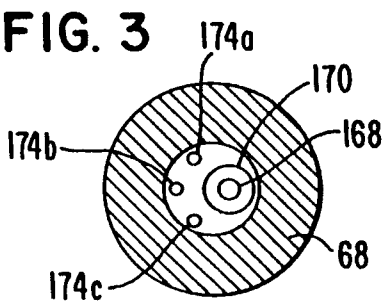
FIG. 3 is a cross-sectional view of the closed nozzle injector of FIG. 2 taken along plane 3—3.
Figure 6:
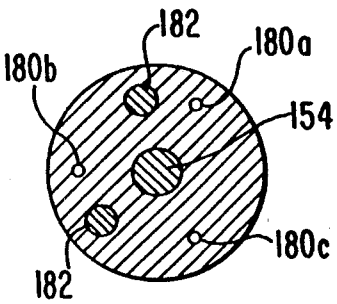
FIG. 6 is a cross-sectional view of a compact closed nozzle assembly of FIG. 2 taken along plane 6—6.

Fuel transfer circuit 160 also includes three fuel transfer passages 174*a, b, c*, formed in outer section 132 and extending inwardly from metering chamber 62. Fuel transfer passage 174*b* communicates at its innermost end with a fuel passage 176*b* extending through inner section 134. Transfer passage 174*a* and 174*c* each communicate at an innermost end with a corresponding connecting passage 178*a* and 178*c*, respectively, formed in the inner surface of outer section 132. Each connecting passage 178*a*, 178*c* extends transversely across outer section 132 to communicate with a respective fuel passage 176*a* and 176*c*. Each fuel passage 176*a*, 176*b* and 176*c* extends through inner section 134 between two of the grooves 208 to communicate with a respective fuel passage 180*a*, 180*b* and 180*c* formed in nozzle housing 76. Fuel passages 180*a–c* extend inwardly to communicate with nozzle cavity 152. During the injection stroke, fuel from metering chamber 62 flows into transfer passages 174*a–c*, through fuel passages 176*a–c* and connecting passages 178*a* and 178*c*, and into corresponding fuel passage 180*a–c* for delivery to nozzle cavity 152. As shown in FIGS. 4–6, dowel pins 182 extending through apertures formed in outer section 132, inner section 134 and nozzle housing 76 may be used to prevent relative rotation of these components while ensuring alignment of the various fuel passages.

As shown in FIG. 2, the nozzle spring 146 of the present invention is of a relatively large diameter as compared to the conventional nozzle spring 24 shown in FIGS. 1A and 1B. As a result, a stationary housing 70 can be positioned within the inner radial extent of nozzle spring 146. Consequently, inlet check valve 172 and transfer passages 174 may be formed in stationary housing 70 thus allowing metering chamber 62, and the remaining upper portions of injector body 64 to be repositioned closer to the closed nozzle assembly 52. As a result, the overall length of fuel injector 50 is reduced creating a more compact, lightweight injector capable of meeting the packaging constraints of many engine mounting arrangements. Moreover, by reducing the axial distance between metering chamber 62 and injector orifice 158, the amount of fuel trapped in the transfer passages which must be compressed during each cycle ("trapped volume") is also reduced which advantageously reduces the response time of the injector. The "trapped volume" and response time is also reduced by directing transfer passages 174 and 176 through a more direct path from the metering chamber through the inner radial extent of nozzle spring 146 without being routed around the nozzle spring as in the conventional closed nozzle assembly.

The compact closed nozzle assembly 52 of the present invention also eliminates a high pressure joint between the metering chamber and the injector orifices. By relocating the metering chamber adjacent the compact closed nozzle assembly 52 while positioning nozzle spring 146 around stationary housing 70 so as to permit supply and transfer passages to be formed within the inner radial extent of nozzle spring 146, the injector can be designed with only two high pressure joints. As injection pressures in unit injectors continue to increase in an effort to improve fuel economy and reduce emissions, the ability to effectively seal the joints in the high pressure region of the injector becomes even more difficult. The present invention relieves some of this burden by reducing one of the high pressure joints.

The compact closed nozzle assembly 52 of the present invention also reduces the overall length of fuel injector 50 by using a nozzle spring 146 which is shorter than the standard nozzle spring used in conventional closed nozzle assemblies. As shown in the Table, the nozzle spring 146 of the present invention has a much larger diameter and shorter length than the conventional nozzle spring. Nozzle spring 146 also possesses less coils than the conventional spring but maintains other characteristics necessary for a nozzle spring to operate effectively.

TABLE

| | Conventional Closed Nozzle Spring | Compact Closed Nozzle Spring of the Present Invention |
|---|---|---|
| Installed force (lbf) | 71.9 | 71.9 |
| Stroke (in) | .0133 | .0133 |
| Maximum force (lbf) | 83.6 | 77.2 |
| Inside diameter (in) | .186 | .6008 |
| Outside diameter (in) | .370 | .8268 |
| Minimum Length (in) | .7083 | .4464 |
| Wire diameter (in) | .092 | .113 |
| Total coils | 7.46 | 3.63 |
| Maximum stress (psi) | 119,626 | 120,361 |
| Minimum stress (psi) | 102,918 | 112,170 |
| Stress @ solid height (psi) | 147,070 | 142,480 |
| Spring rate (lbf/in) | 878 | 394 |

For example, the stroke, force and stress requirements of nozzle spring 146 are substantially similar to the standard nozzle spring. As shown in the Table, the nozzle spring 146 of the present invention has the distinct advantage of possessing a smaller spring rate than the conventional nozzle spring. During assembly, shims are often used between one end of the nozzle spring and the corresponding support surface to precisely set the opening pressure of the nozzle valve element. This adjustment process is necessary due to unavoidable variations in the dimensions of the components of the closed nozzle assembly. Each variation in the installed height of the spring will effect the opening pressure of the spring to a greater or lesser degree depending on the spring rate of the nozzle spring. The greater the spring rate, the greater the effect the variation in spring height, for example, 1/1000 of an inch, will have on the ultimate force required to move the nozzle valve element against the nozzle spring. Therefore, the smaller the spring rate the less effect height variations will have on the ultimate opening force. As a result, the nozzle spring of the present invention helps reduce the number of injectors requiring shims to set the opening pressure thereby increasing predictability in the assembly process while reducing costs.

Figure 8:
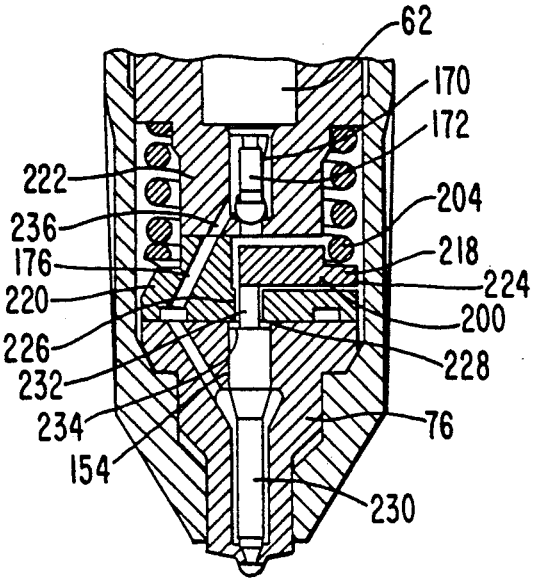
FIG. 8 is a partial cross-sectional view of an alternative embodiment of the present invention including a stationary housing having an outer section integrally formed with the injector inner barrel and a button positioned between the housing inner and outer sections.

In an alternative embodiment of the present invention, as shown in FIG. 8, a button 218 may be positioned between an inner section 220 and an outer section 222 instead of being positioned between the inner section and nozzle housing 76. As with the previous embodiment, button 218 includes three radially extending legs 200 each having a seating surface 204. However, legs 200 are positioned in three complementary grooves 224 formed in inner section 220 adjacent outer section 222. In addition, inner section 220 includes a center bore 226 extending from central bore 154 of nozzle housing 76. Center bore 226 has a smaller diameter than central bore 154 so that a portion of inner section 220 forms an annular land 228 around central bore 154. A nozzle valve element 230 includes a small diameter portion 232 slidably extending through center bore 226 to engage button 218. Nozzle valve element 230 also includes an annular land 234 for abutment with annular land 228 creating a stopping device for setting the maximum stroke length of nozzle valve element 230. Another distinction of the embodiment shown in FIG. 8 is that check valve cavity 170 and check valve 172 are positioned coaxial with metering chamber 62. As a result, transfer passages 236 may extend from the check valve cavity 170 to communicate with fuel passages 176 instead of extending from metering chamber 62. Thus, the "trapped volume" of the injector is further reduced thereby reducing the response time.

Figure 9:
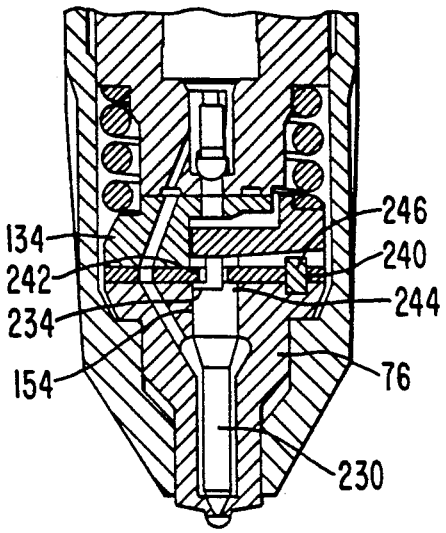
FIG. 9 is a third embodiment of the present invention including a stationary housing having an outer section integrally formed with the injector inner barrel and a button positioned between the housing inner section and the discharge orifice.

FIG. 9 represents another embodiment of the present invention which is the same as the embodiment shown in FIG. 2 except that an additional spacer 240 is positioned between inner section 134 and nozzle housing 76. Spacer 240 includes a center bore 242 having a smaller diameter than central bore 154 to form an annular land 244 which functions as a stop to limit the outward travel of nozzle valve element 230 by engaging annular land 234 and in this respect is similar to the embodiment of FIG. 8. A pin 246 is used to secure spacer 240 in position relative to nozzle housing 76.

Figure 10:
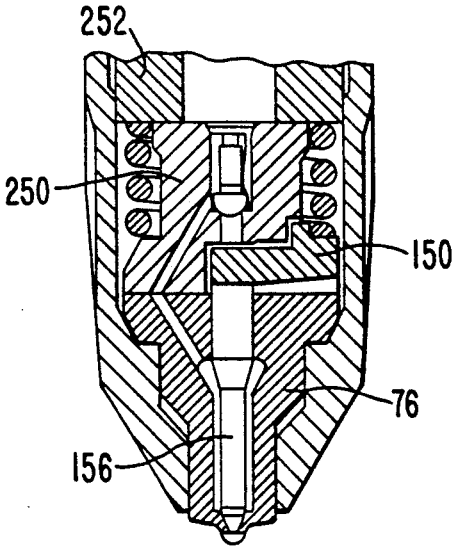

FIG. 10 illustrates another embodiment of the present invention using a one-piece stationary housing 250 which is separate from an inner barrel 252. As a result, the high pressure joint located between the inner and outer sections of the stationary housing disclosed in the previous embodiments is relocated and formed between the inner barrel 252 and the one-piece housing 250.

Figure 11:
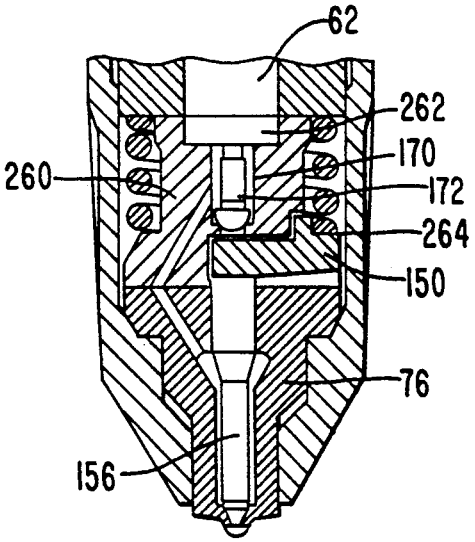
FIG. 11 is a fourth embodiment of the present invention including a one-piece stationary housing.

FIG. 11 represents yet another embodiment of the present invention which is the same as the embodiment of FIG. 10 except that a one-piece stationary housing 260 is provided with a cylindrical recess 262 axially aligned with metering chamber 62 to form the lower portion of metering chamber 62. In this arrangement, the axial supply passage 264 communicating with check valve cavity 170 is shortened to allow check valve 172 and valve cavity 170 to be positioned as far inward as possible. As a result, the overall length of the fuel injector can be minimized while still effectively controlling the discharge from the injector orifices.

Industrial Applicability

The compact closed nozzle assembly of the present invention is useful in a variety of industrial applications requiring pulsed fuel injection. A particularly desirable application of the invention is for use with a fuel injector of an internal combustion engine. The present invention may be incorporated into many types of fuel injectors, such as the disclosed unit fuel injector which may be used in a variety of industrial/commercial applications such as electrical generators, pump power plants and other stationary installations for internal combustion engines.

What is claimed is:

1. A fuel injector adapted to inject fuel at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a nozzle valve element positioned in one end of said injector cavity adjacent said injector orifice, said nozzle valve element operable to be placed in an open position in which fuel may flow from said fuel transfer circuit through said injector orifice into the combustion chamber and a closed position in which fuel flow through said injector orifice is blocked;

biasing means operatively connected to said nozzle valve element for biasing said nozzle valve element into said closed position, said biasing means including a nozzle spring having an inner radial extent, wherein said injector body includes a stationary housing mounted in said injector cavity adjacent said nozzle valve element, at least a portion of said stationary housing being positioned within said inner radial extent of said nozzle spring and at least a portion of said fuel transfer circuit being formed in said stationary housing within said inner radial extent of said nozzle spring.

2. The fuel injector of claim 1, further including a plunger means mounted for reciprocable movement in said injector cavity to define a metering chamber positioned at a first end of said injector cavity adjacent said stationary housing for receiving supply fuel at relatively low pressure for transfer to said injector orifice at relatively high pressure, said fuel transfer circuit including a supply passage for supplying fuel to said metering chamber and at least one transfer passage for transferring fuel from said metering chamber to said injector orifice, wherein said supply passage and said at least one transfer passage extend through said inner radial extent of said nozzle spring.

3. The fuel injector of claim 2, wherein said portion of said stationary housing includes a cylindrical recess axially aligned with said injector cavity for receiving said plunger means said cylindrical recess forming a portion of said metering chamber positioned within said inner radial extent of said nozzle spring.

4. The fuel injector of claim 2, wherein said plunger means includes a timing plunger positioned in said injector cavity, a metering plunger positioned in said injector cavity adjacent said metering chamber, and an intermediate plunger positioned in said injector cavity between said timing plunger and said metering plunger to form a timing chamber between said timing plunger and said intermediate plunger for receiving timing fluid, said timing chamber having a greater diameter than said metering chamber.

5. The fuel injector of claim 2, further including a check valve positioned in said portion of said fuel transfer circuit within said inner radial extent of said nozzle spring for preventing the flow of fuel from said metering chamber into said supply passage.

6. The fuel injector of claim 5, wherein said injector body further includes an inner barrel mounted adjacent said nozzle spring, said metering chamber being formed in said inner barrel, said nozzle spring including an outer end mounted against said inner barrel and an inner end axially spaced from said outer end, further including a button positioned adjacent said nozzle valve element, said button including a seating surface for abutment with said inner end of said nozzle spring, said nozzle spring biasing said button into abutment with said nozzle valve element.

7. The fuel injector of claim 6, wherein said button includes a plurality of legs extending radially outward from said nozzle valve element toward said nozzle spring, said stationary housing including a plurality of grooves corresponding to said plurality of legs for receiving said plurality of legs, said seating surface of said button being formed on said plurality of legs.

8. The fuel injector of claim 7, wherein said plurality of grooves includes three grooves equally spaced around the circumference of said stationary housing, said fuel transfer circuit further including a check valve cavity formed in said stationary housing for receiving said check valve, said check valve cavity communicating with said metering chamber at one end and with said supply passage at an opposite end, said fuel transfer circuit further including three transfer passages formed in stationary housing, each of said three transfer passages extending from said check valve cavity between two of said three grooves for delivering fuel to said injector orifice.

9. The fuel injector of claim 6, wherein said stationary housing includes an outer section formed integrally with said inner barrel and an inner section compressively positioned between said outer section and said injector orifice, said outer section position substantially entirely within said inner radial extent of said nozzle spring.

10. The fuel injector of claim 9, wherein said button includes a plurality of legs extending radially outward from said nozzle valve element toward said nozzle spring, said inner section of said stationary housing including a plurality of grooves corresponding to said plurality of legs for receiving said plurality of legs, said seating surface of said button being formed on said plurality of legs.

11. The fuel injector of claim 10, wherein said portion of said fuel transfer circuit includes a plurality of first transfer passages formed in said outer section of said stationary housing substantially within said inner radial extent of said nozzle spring and a plurality of second transfer passages formed in said inner section, each of said first transfer passages communicating with said metering chamber at one end and with a respective one of said second transfer passages at a second end, each of said second transfer passages extending through said inner section between two of said plurality of grooves.

12. The fuel injector of claim 11, wherein said inner section includes a central bore adapted to receive said nozzle valve element and said plurality of grooves are formed in said inner section adjacent said outer section, said button being movably positioned in said grooves between said inner section and said outer section of said stationary housing.

13. The fuel injector of claim 1, wherein said injector body includes an inner barrel positioned adjacent said stationary housing, said stationary housing including an outer section positioned adjacent to and formed integrally with said inner barrel, and an inner section positioned between said outer section and said injection orifice.

14. The fuel injector of claim 1, wherein said nozzle spring has less than four coils.

15. A unit fuel adapted to receive fuel from a fuel supply at relatively low pressure and adapted to inject fuel at relatively high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

plunger means mounted for reciprocable movement in said injector cavity to define a metering chamber for receiving supply fuel at relatively low pressure for transfer to said injector orifice at relatively high pressures;

a nozzle valve element positioned between said metering chamber and said injector orifice, said nozzle valve element operable to be placed in an open position in which fuel may flow from said fuel transfer circuit through said injector orifice into the combustion chamber and a closed position in which fuel flow through said injector orifice is blocked;

biasing means operatively connected to said nozzle valve element for biasing said nozzle valve element into said closed position, said biasing means including a nozzle spring having an inner radial extent, wherein said injector body includes a stationary housing mounted in said injector cavity adjacent said nozzle valve element, at least a portion of said stationary housing positioned within said inner radial extent of said nozzle spring adjacent said nozzle spring element, at least a portion of said metering chamber formed in said injector cavity adjacent said portion of said stationary housing positioned within said inner radial extent of said nozzle spring.

16. The injector of claim 15, wherein said portion of said stationary housing includes a cylindrical recess axially aligned with said injector cavity for receiving said plunger means, said cylindrical recess forming a portion of said metering chamber positioned within said inner radial extent of said nozzle spring.

17. The fuel injector of claim 15, wherein said injector body further includes an inner barrel mounted adjacent said nozzle spring, said injector cavity being formed in said inner barrel, said stationary housing including an outer section formed integrally with said inner barrel and an inner section compressively positioned between said outer section and said injector orifice, said outer section positioned substantially entirely within said inner radial extent of said nozzle spring.

18. The fuel injector of claim 17, wherein said nozzle spring includes an outer end mounted against said inner barrel and an inner end axially spaced from said outer end, further including a button positioned adjacent said nozzle valve element, said button including a seating surface for abutment with said inner end of said nozzle spring, said button including a plurality of legs extending radially outward from said nozzle valve element toward said nozzle spring, said inner section of said stationary housing including a plurality of grooves corresponding to said plurality of legs for receiving said plurality of legs, said seating surface of said button being formed on said plurality of legs.

19. The fuel injector of claim 18, wherein said fuel transfer circuit includes a plurality of first transfer passages formed in said outer section of said stationary housing substantially within said inner radial extent of said nozzle spring and a plurality of second transfer passages formed in said inner section, each of said first transfer passages communicating with said metering chamber at one end and with a respective one of said second transfer passages at a second end, each of said second transfer passages extending through said inner section between two of said plurality of grooves.

20. The fuel injector of claim 15, wherein at least a portion of said fuel transfer circuit is formed in said stationary housing within said inner radial extent of said nozzle spring, said fuel transfer circuit including a supply passage for supplying fuel to said metering chamber and at least one transfer passage for transferring fuel from said metering chamber to said injection orifice, and including a check valve positioned in said portion of said fuel transfer circuit for preventing the flow of fuel from said metering chamber into said supply passage.

21. The fuel injector of claim 15, wherein said injector body further includes an inner barrel mounted adjacent said nozzle spring, said injector cavity being formed in said inner barrel, said nozzle spring including an outer end mounted against said inner barrel and an inner end axially spaced from said outer end, further including a button positioned adjacent said nozzle valve element, said button including a seating surface for abutment with said inner end of said nozzle spring, said nozzle spring biasing said button into abutment with said nozzle valve element, said button including a plurality of legs extending radially outward from said nozzle valve element toward said nozzle spring, said stationary housing including a plurality of grooves corresponding to said plurality of legs for receiving said plurality of legs, said seating surface of said button being formed on said plurality of legs.

22. The fuel injector of claim 15, wherein said plunger means includes a timing plunger positioned in said injector cavity, a metering plunger positioned in said injector cavity adjacent said metering chamber, and an intermediate plunger positioned in said injector cavity between said timing plunger and said metering plunger to form a timing chamber between said timing plunger and said intermediate plunger for receiving timing fluid, said timing chamber having a greater diameter than said metering chamber.

23. The fuel injector of claim 15, wherein said nozzle spring has less than four coils.

24. A fuel injector adapted to inject at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a nozzle valve element positioned in one end of said injector cavity adjacent said injector orifice, said nozzle valve element operable to be placed in an open position in which fuel may flow from said fuel transfer circuit through said injector orifice into the combustion chamber and a closed position in which fuel flow through said injector orifice is blocked;

biasing means operatively connected to said nozzle valve element for biasing said nozzle valve element into said closed position, said biasing means including a nozzle spring;

a connecting means for operatively connecting said nozzle spring to said nozzle valve element, said connecting means including a plurality of radially extending legs, each of said radially extending legs including a seating surface formed at a peripheral end of each of said plurality of legs for engaging one end of said nozzle spring, said nozzle valve element connected to a central portion of said connecting means, said connecting means adapted to transmit a biasing force from said nozzle spring acting on said seating surface to said nozzle valve element at said central portion.

25. The fuel injector of claim 24, wherein said nozzle spring includes an inner radial extent and said injector body includes a stationary housing mounted in said injector cavity adjacent said nozzle valve element, at least a portion of said stationary housing being positioned within said inner radial extent of said nozzle spring and at least a portion of said fuel transfer circuit being formed in said stationary housing within said inner radial extent of said nozzle spring.

26. The fuel injector of claim 25, wherein said fuel transfer circuit includes a supply passage formed in said stationary housing for supplying fuel for delivery to said injector orifice, said supply passage extending through said inner radial extent of said nozzle spring.

27. The fuel injector of claim 26, further including a check valve positioned in said supply passage within said inner radial extent of said nozzle spring.

28. The fuel injector of claim 25, wherein said injector body includes an inner barrel positioned adjacent said stationary housing, said stationary housing including an outer section positioned adjacent to and formed integrally with said inner barrel, and an inner section positioned between said outer section and said injection orifice.

* * * * *